United States Patent [19]

Hidle

[11] Patent Number: 4,535,947

[45] Date of Patent: Aug. 20, 1985

[54] PAPER TOWEL INSERT AND DISPENSER

[75] Inventor: Jerry Hidle, Panama City, Fla.

[73] Assignee: Pandhandle Industries, Inc., Panama City, Fla.

[21] Appl. No.: 596,352

[22] Filed: Apr. 3, 1984

[51] Int. Cl.[3] ..... B65H 19/00

[52] U.S. Cl. ..... 242/55.2; 242/129.51; 242/68.4

[58] Field of Search ..... 242/55.2, 55.3, 68, 242/68.3, 68.4, 71.9, 129.51, 129.53, 115; 225/46, 47; 403/109, 377-379; 206/416

[56] References Cited

U.S. PATENT DOCUMENTS

| | | | |
|---|---|---|---|
| 1,667,916 | 5/1928 | Williams | 242/68.4 |
| 2,592,571 | 4/1952 | Huntington | 242/55.2 |
| 2,917,249 | 12/1959 | MacLelland | 242/55.2 |
| 3,002,705 | 10/1961 | Isbell | 242/68.2 |
| 4,083,450 | 4/1978 | La Mar | 206/416 |
| 4,101,095 | 7/1978 | Carter | 242/115 |

*Primary Examiner*—Leonard D. Christian

*Attorney, Agent, or Firm*—Watson, Cole, Grindle & Watson

[57] ABSTRACT

A dispenser for rolled material includes a pair of opposed support arms each provided with a cylindrical support for insertion within a tube about which the rolled material is scrolled. A tubular support assembly is provided for insertion within each cylindrical support for increasing the degree of axial support for more positively supporting and securing the roll upon the dispenser. The support tube may be designed to accommodate a commercially available paper roll dispenser or may be provided within a paper roll dispenser particularly adapted to receive the support tube. The support tube includes a finger grasping bar disposed therein for axially moving the support tube within the support cylinder. A locking bar is secured to the finger grasping bar and projects radially outwardly therefrom through an aperture formed within the support tube for engagement with the support cylinder. A biasing mechanism is provided for biasing the locking bar radially outwardly for securing the support tube within the support cylinder.

9 Claims, 8 Drawing Figures

PAPER TOWEL INSERT AND DISPENSER

BACKGROUND OF THE INVENTION

1. Field of the Invention

This invention generally concerns dispensing apparatus for rolled material, and more particularly to paper towel dispensers and an insert assembly for securing a roll of paper towels to a paper towel holder.

2. Description of the Prior Art

A common problem encountered in connection with the dispensing of rolled articles is the unintended disconnection of scrolled material such as roll or paper towels, wax paper, or any other similar material from its support. For example, a roll of paper towels is usually supported between a pair of opposing support arms. The support arms are each typically provided with a cylindrical support which is axially inserted within a hollow tubular member about which the paper towels are scrolled. The cylindrical supports are usually biased towards the center of the rolled article by the inherent elastic properties of the support arm material. Accordingly, the support arms must be deformed outwardly and spread apart so as to allow the cylindrical supports to be inserted within the roll of paper towels.

Once the roll has been mounted upon a dispenser in the manner indicated above, it frequently occurs that the roll becomes dismounted unintentionally during use. That is, while a supply of material is being unrolled from the dispenser, the force applied to the cylindrical supports will cause the support arms to deflect so as to allow one or both ends of the roll of material to become disconnected from the support arms. This type of mishap often results in a loss of the scrolled material and, of course, results in the inconvenience associated with remounting the roll upon its support.

While many paper towel holders have been designed, none offers the simplicity and economy of the present invention. For example, Hudgel discloses in U.S. Pat. No. 1,153,389 a paper towel holder having a spring biased rod fitted with a plunger. The rod and plunger are disposed within a sleeve formed upon an end portion of a paper holder support arm. The plunger is axially displaced to allow for the mounting and removal of a roll of paper material.

Another paper roll support is disclosed by MacLelland in U.S. Pat. No. 2,917,249 wherein pins anchored within an internal sleeve effect axial displacement of the sleeve into and out of a paper roll via coaction with arcuate cam surfaces. The cam surfaces are formed within an outer sleeve provided along an end portion of each paper towel holder arm.

Yet another supply holder for rolled material is shown by Simmons in U.S. Pat. No. 2,905,404. A pair of nested telescoping plungers are biased axially inwardly towards a central tubular core which supports the rolled material.

Thus, there exists the need for a simple and economical device for securing and locking a roll of material such as paper towels between a pair of opposed support arms.

SUMMARY OF THE INVENTION

Accordingly, this invention has been made to overcome the problems and meet the needs described above, and therefore has an object to provide an apparatus for supporting, retaining and selectively locking a roll of material to a support assembly from which it is rotatingly dispensed.

A further object is to facilitate the insertion and removal of a roll of paper towels from its support assembly.

Yet another object is to provide a simple and economical device which is easy to operate for facilitating mounting a roll of material therein and removing a roll of material therefrom.

The foregoing and other objects are achieved according to the present invention by the provision of an apparatus for preventing a paper roll from sliding off its support arms. A support tube is concentrically disposed within a support cylinder of a paper towel holder such as those currently commercially available. The support tube is inserted within either or both cylindrical support cylinders which are usually provided along the end portions of a pair of support arms. The support tube is adapted for axial displacement within the support cylinder. The support cylinder may be formed with an annular groove adjacent each support arm and a locking mechanism may be provided on the support tube to selectively lock the support tube within the paper towel support cylinder by positively engaging a locking bar provided on the support tube within the annular groove formed within the paper towel cylinder or with the inner surface of the support cylinder.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENT

The apparatus developed in accordance with the present invention will now be described in conjunction with the accompanying Figures.

Figure 1:
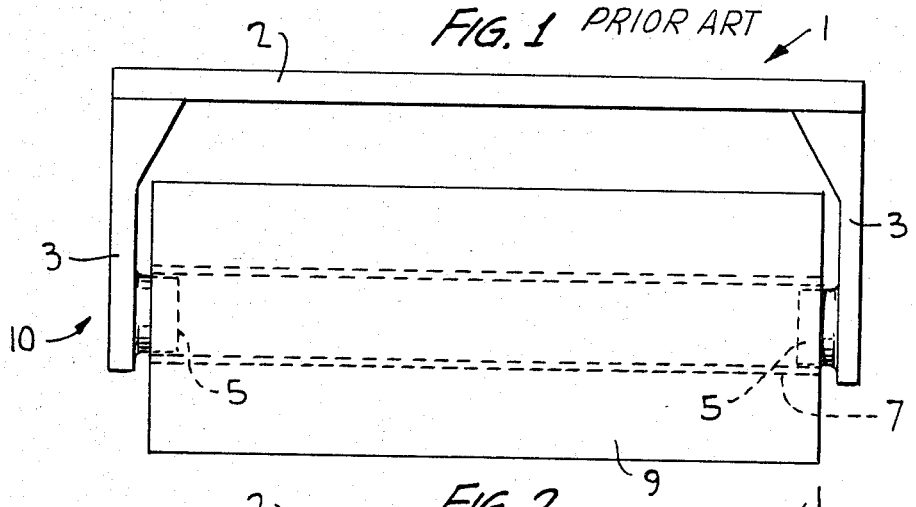
FIG. 1 PRIOR ART
FIG. 1 is a front elevation view of a prior art paper roll dispenser.

In FIG. 1 is shown a paper roll dispenser 1 of known construction. A central body section 2 is typically secured to a wall or similar support surface. A pair of support arms 3,3 are provided on opposing end sections of the central body section 2 of the paper roll dispenser 1. Each of the support arms includes a support cylinder 5 for insertion within a paper roll tube 7 about which a roll of paper material 9 is scrolled. The paper roll tube 7 is typically mounted within the paper roll dispenser 1 by fitting one end of the paper roll tube 7 over one of the support cylinders 5 and applying an axial force generally along the direction of the paper roll axis 10 so as to deflect the respective support arm 3 outwardly to allow the opposing end of the paper roll 9 to be fitted over the opposing support cylinder 5. The paper roll tube 7 is then released and the elastically deformed support arm then returns to its normal unstressed position so as to secure the paper roll 9 upon the support cylinders 5,5.

Once a paper roll has been mounted in the manner described above, it is not uncommon for the paper roll 9 to be unintentionally dismounted or disconnected from the paper roll dispenser 1. This typically occurs when a user exerts a relatively large force upon the paper roll 9 when tearing a quantity of paper from the roll. A component of force is directed along the axis 10 of the paper roll 9 so as to deflect one or both of the support arms outwardly thereby allowing the paper roll tube 7 to become disconnected from the support cylinders 5 such that the paper roll 9 becomes disconnected from the dispenser 1.

In order to prevent such unintentional removal of the paper roll 9 from the paper roll dispenser 1, the axial penetration of the support cylinders 5 within the paper roll tube 7 may be increased. However, by increasing such penetration the outward deflection of the support arms 3 must be increased. If the paper roll dispenser 1 is to be formed of an economical material such as a plastic material, the outward deflection of the support arms 3 is effectively limited upon reaching the elastic limit of the material. The same consideration applies for a paper roll dispenser 1 formed of a metallic material. It has been found that the elastic limit of such plastic or metallic material is reached before an adequate clearance is provided between opposing support arms 3,3 to allow a paper roll 9 of standard commercially available dimensions to be mounted upon support cylinders 5,5 having an axial penetration within the paper roll tube 7 sufficiently deep to prevent any unintentional removal of the paper roll 9 from the paper roll dipenser 1.

Figure 2:
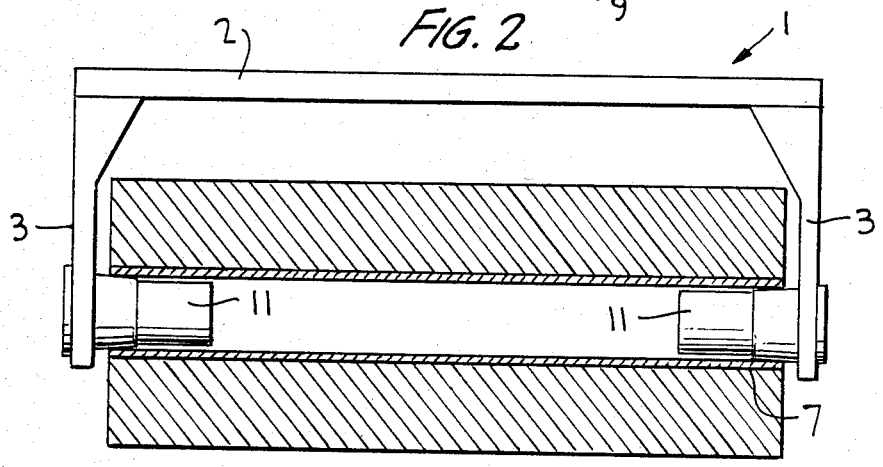
FIG. 2 is a front elevation view showing a paper roll dispenser fitted with a support tube according to the present invention.

Due to the elastic limits and design considerations noted above, a support tube insert 11, as shown in FIG. 2, is provided to prevent the unintended removal of the paper roll 9 from the dispenser 1 without requiring deflection of the support arms 3 past their elastic limit. Either a single support tube insert 11 or a pair of support tube inserts may be provided with each paper roll dispenser 1.

Figure 3:
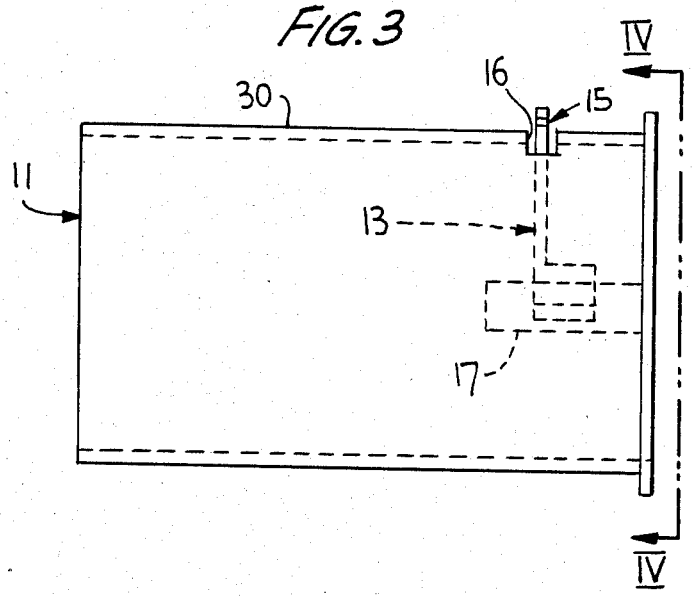
FIG. 3 is a front elevation view of a support tube insert.
Figure 4:
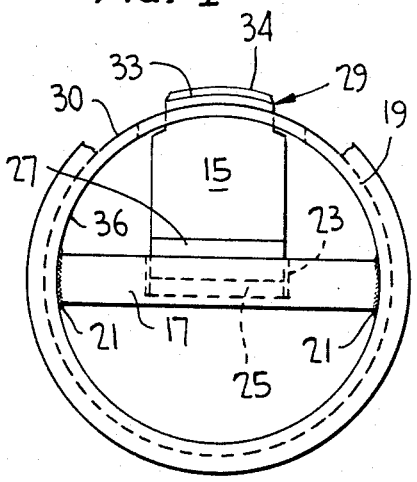
FIG. 4 is an axial end view of the support tube insert of FIG. 3 taken along lines IV—IV of FIG. 3.
Figure 5:
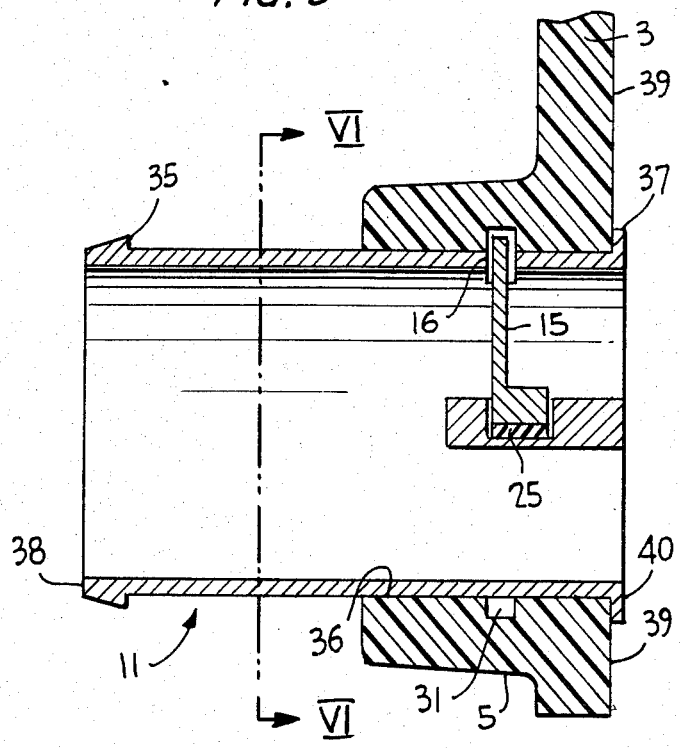
FIG. 5 is a front sectional view of the support tube insert inserted within a support cylinder of a paper roll dispenser.
Figure 6:
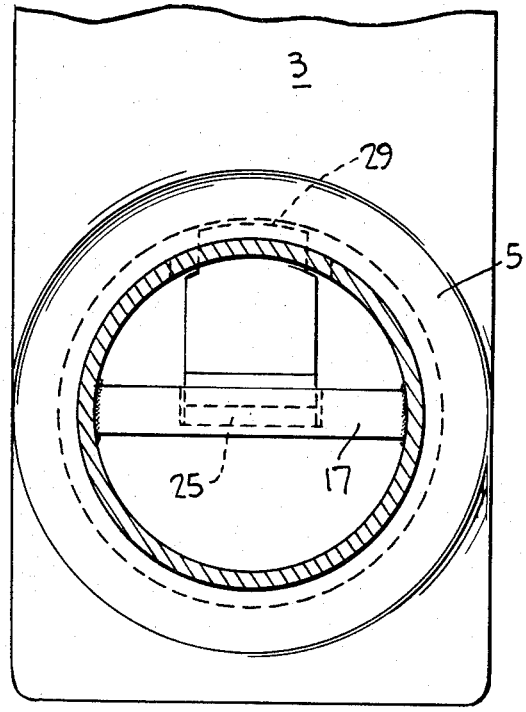
FIG. 6 is an axial sectional view of the support tube insert taken along lines VI—VI of FIG. 5.

The support tube insert 11 is shown in greater detail in FIGS. 3 and 4 wherein a locking bar 15 is shown attached to a finger grasp bar 17. The grasp bar 17 is permanently secured to support tube 19 by, for example, a simple frictional interference fit or by gluing along interface 21 between the grasp bar 17 and the support tube 19. A recess 23 may be formed within the finger grasp bar 17 to receive an elastic element 25. The elastic element may be formed of a solid rubber material or a foam rubber material and may be secured to the inner surface of recess 23, by, for example, glue. A base portion 27 of the locking bar 15 is similarly secured to the upper surface of the elastic element 25 and is dimensioned to be slidingly received within the recess 23. In this manner, the base portion 27 of the locking bar 15 may be depressed within the recess 23 by a pinching action such that the locking bar 15 is displaced radially inwardly within the support tube 19. This inward radial movement of the locking bar 15 causes a locking projection 29 to move beneath the outer surface 30 of support tube 19. As shown in FIGS. 5 and 6, such movement will allow the support tube insert 11 to be axially moved within support cylinder 5 from the operative position shown in FIG. 5 to a retracted loading position.

As further shown in FIG. 5, the support cylinder 5 may be formed with a annular groove 31 for receiving the locking projection 29. Annular groove 31 is not essential however, as the outer edge portion 33 of locking projection 29 may be coated with a material 34 having a high coefficient of friction such as a rubber material to effect a frictional contact with the inner cylindrical surface 36 of the support cylinder 5.

The inner end 38 of support tube 19 may be provided with a radially outwardly extending shoulder portion 35 having and outer diameter slightly greater than the inner diameter of the support cylinder 5. This construction will allow the support tube 19 to be inserted within the support cylinder 5 yet prevent the support tube 19 from being withdrawn therefrom once inserted. An outer flange 37 may be provided along the outer end surface portion 40 of support tube 19 to align the locking bar 15 with the annular groove 31 in the case where the support cylinder 5 is provided with such annular groove. Alignment is thus achieved when flange 37 abuts the outer surface portion 39 of support cylinder 5. Even if the support cylinder 5 is not provided with an annular groove 31, the outer flange 37 prevents the insertion of support tube 19 past the outer surface 39 of the support cylinder 5. Thus, with a support tube insert 11 provided with both a shoulder 35 and outer flange 37, the support tube insert, once inserted in the support cylinder 5, will be permanently secured therein so as to prevent its subsequent misplacement or loss.

Figure 7:
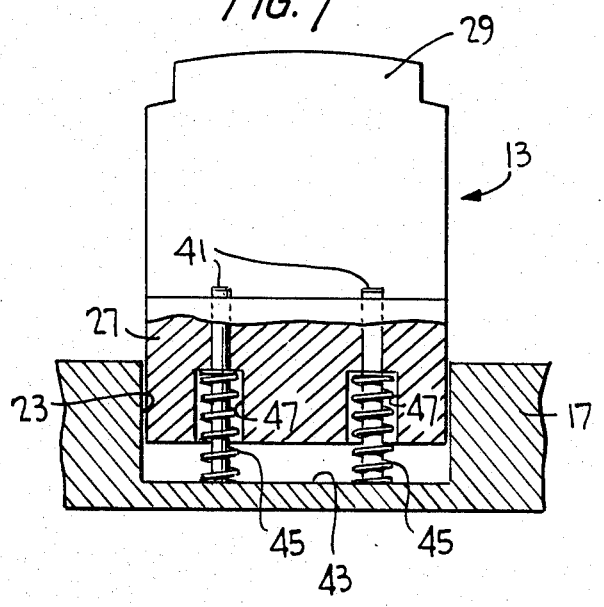
FIG. 7 is a fragmented sectional view of a locking bar mechanism of the support tube insert.

FIG. 7 shows an alternate embodiment of the locking bar assembly 13. In this embodiment, one or two guide posts 41 are secured to the inner surface 43 of recess 23. Coil springs 45 may be mounted over each post 41. The base 27 of the locking bar 15 may be formed with recesses 47 to receive therein the guide posts 41 as well as the coil springs 45. This embodiment is particularly suited to a support tube insert 11 fitted within a support cylinder 5 lacking an annular groove 31 for receiving the locking projection 29. That is, commercially available dispensers do not have an annular groove 31, and therefore such dispensers may be fitted with an insert according to the invention so that only one or two inserts need be obtained for practicing the invention. The coil springs 45 may be dimensioned to provide a force greater than that attainable with elastic element 25 so as to generate the necessary frictional contact between locking projection 29 and the inner surface of the support cylinder 5.

Figure 8:
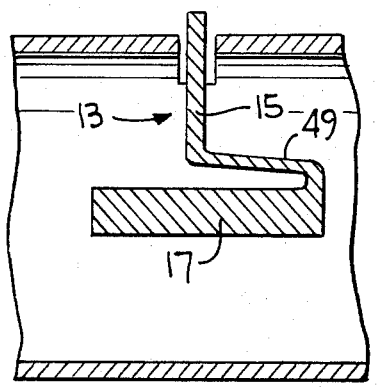
FIG. 8 is a sectional view of a one-piece embodiment of the locking bar assembly.

Yet another embodiment of the locking bar assembly 13 is shown in FIG. 8 wherein a one-piece homogeneous assembly is disclosed. A far simple design is achieved by forming a leaf spring bar 49 upon the grasp bar 17 so as to obviate the provision of recess 23 as well as elastic element 25 or spring 45. Any resilient material may be used to form the one-piece locking bar 13 shown in FIG. 8. For example, a resilient plastic material is ideally suited since the locking bar assembly 13 may then be formed in a single simple injection molding operation.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A paper roll dispenser, comprising:

a central body portion;

first and second support arms respectively extending from opposite end portions of said central body portion for supporting a paper roll therebetween;

first and second support cylinders provided on respective end portions of said support arms for insertion within the paper roll for supporting the roll thereon, said support cylinders each having a predetermined length and extending inwardly toward each other from inner surfaces of said end portions;

a support tube axially received within at least one said support cylinder for axial movement relative thereto and having a length substantially greater than said predetermined length of said one support cylinder, grasp means on said support tube for axially moving said tube within said one support cylinder between an inwardly projected position and an outwardly extended position, first means on said support tube extending radially outwardly from the outer surface thereof engageable with said one support cylinder for limiting movement of said tube in said outwardly extended position thereof, and second means on said support tube extending radially outwardly from said outer surface thereof engageable with said one support cylinder for limiting movement of said tube in said inwardly projected position thereof and for retaining said tube in said inwardly projected position, whereby said support tube in said inwardly projected position thereof extends a greater distance within the paper roll compared to that of said one support cylinder for further supporting the roll and for preventing unintended removal of the paper roll from the dispenser.

2. The dispenser according to claim 1, wherein said second means on said support tube comprises a flange and a locking bar in engagement with said one support cylinder in said inwardly projected position.

3. The dispenser according to claim 2, wherein said support tube has an aperture formed therein through which said locking bar extends, said grasp means comprising a grasp bar, and biasing means on said bar for biasing same radially outwardly such that said bar secures said one support tube within said support cylinder.

4. The dispenser of claim 3, wherein said support cylinder includes an annular groove formed therein for receiving said locking bar to lock said support tube within said support cylinder.

5. the dispenser of claim 3, wherein said biasing means comprises an elastic rubber element.

6. The dispenser of claim 3, wherein said grasp bar includes a recess formed therein and wherein said biasing means is secured within said recess.

7. The dispenser of claim 3, wherein said locking bar comprises a base portion having at least one recess formed therein, wherein said grasp bar comprises at least one recess formed therein for receiving said base portion of said locking bar, and wherein said biasing means comprises at least one guide post fixed within said at least one recess formed within said grasp bar, said biasing means fitted within said recess formed in said base portion of locking bar, and a coil spring fitted over said guide post, one end portion of said coil spring engaging said grasp bar and another end portion of said coil spring engaging in interior portion of said recess formed in said base portion of said locking bar.

8. The dispenser of claim 3, wherein said grasp bar, said biasing means and said locking bar are formed together as a one-piece homogeneous assembly.

9. The dispenser of claim 8, wherein said biasing means comprises a leaf spring interconnecting said grasp bar and said locking bar.

* * * * *